United States Patent [19]

Hulbert

[11] Patent Number: 5,039,995

[45] Date of Patent: Aug. 13, 1991

[54] DISTRIBUTED ANTENNA SYSTEM

[75] Inventor: Anthony P. Hulbert, Southampton, England

[73] Assignee: GEC Plessey Telecommunications Limited, Coventry, England

[21] Appl. No.: 276,098

[22] Filed: Nov. 23, 1988

[30] Foreign Application Priority Data

Nov. 30, 1987 [GB] United Kingdom ..... 8727960

[51] Int. Cl.[5] ..... H01Q 21/00; H01P 1/32

[52] U.S. Cl. ..... 343/853; 333/1.1; 343/844

[58] Field of Search ..... 343/876, 853, 844, 850; 333/1.1, 116, 24.2, 126, 128, 129, 132, 134; 342/375

[56] References Cited

U.S. PATENT DOCUMENTS

| | | | |
|---|---|---|---|
| 3,422,438 | 1/1969 | Marston | 343/854 |
| 4,028,632 | 6/1977 | Carter et al. | 333/24.2 |
| 4,109,202 | 8/1978 | Kudsiz et al. | 333/134 |
| 4,559,489 | 12/1985 | Vacanti et al. | 333/1.1 |
| 4,661,993 | 4/1987 | Leland et al. | 333/1.1 |
| 4,688,259 | 8/1987 | Edridge | 333/1.1 |
| 4,933,680 | 6/1990 | Shapiro et al. | 343/853 |

OTHER PUBLICATIONS

Ladner et al., Shortwave Wireless Communication, Chapman &. Hall, Ltd., London, pp. Preface, 124–127, 194 & 195, 1946.

Antenna Systems, Air Force Manual, 52-19, Washington, D.C., Jun. 1953, pp. 54–55.

*Primary Examiner*—Michael C. Wimer

*Assistant Examiner*—Peter T. Brown

*Attorney, Agent, or Firm*—Fleit, Jacobson, Cohn, Price, Holman & Stern

[57] ABSTRACT

A distributed antenna system comprises a plurality N of spaced apart antennas 3, each antenna being connected to a RF line 2 via a circulator 4, wherein each circulator 4 is arranged to pass to its associated antenna a fraction 1/N of the RF power incident thereon.

This can allow cost savings in providing the components needed for the antenna installation.

2 Claims, 1 Drawing Sheet

DISTRIBUTED ANTENNA SYSTEM

This invention relates to a distributed antenna system. It relates particularly to such a system which comprises a number of antennas which are spaced apart from one another being arranged for example along the length of a tunnel.

Certain types of environment are best served, for radio communication purposes, by some form of distributed antenna. It has been a practice hitherto to use leaky feeder cables to supply these antennas, however, there is also a system where several discrete antennas are fed by a coaxial cable through a suitable form of coupling. The latter arrangement has tended to be either lossy or complex.

The present invention was devised to provide a distributed antenna system which would be capable of being manufactured at low cost and would be suitable for reception and transmission purposes.

According to the invention, there is provided a distributed antenna system comprising a plurality N of spaced apart antennas, each antenna being connected to a RF line via a circulator, wherein each circulator is arranged to pass to its associated antenna a fraction 1/N of the RF power incident thereon.

Preferably, each antenna of the plurality is coupled to the RF line in a manner which includes a mismatch such that the said antenna radiates only a predetermined fraction of the power which is incident thereon. The antennas of the plurality may have differing physical lengths.

Transmit and receive signals may be delivered to the RF line at differing frequencies. Each antenna may be connected through a switch to its respective circulator. Each switch may be capable of being controlled by a signal sent down the RF line.

In one embodiment, a last antenna of the system is connected by an independent return line to a RF source for the system.

Figure 1:
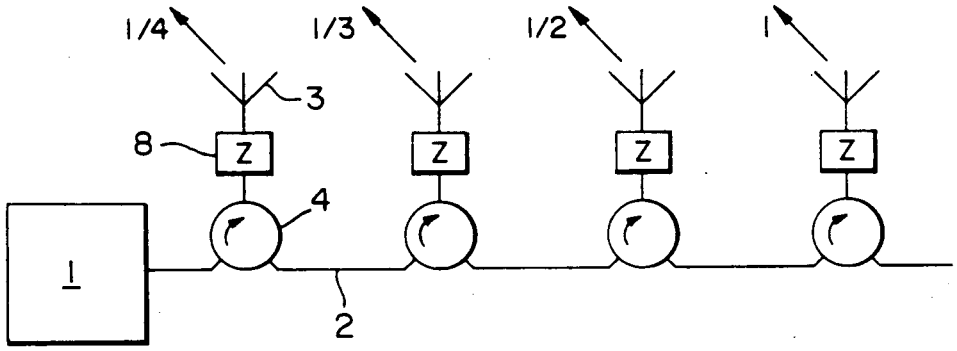
Figure 2:
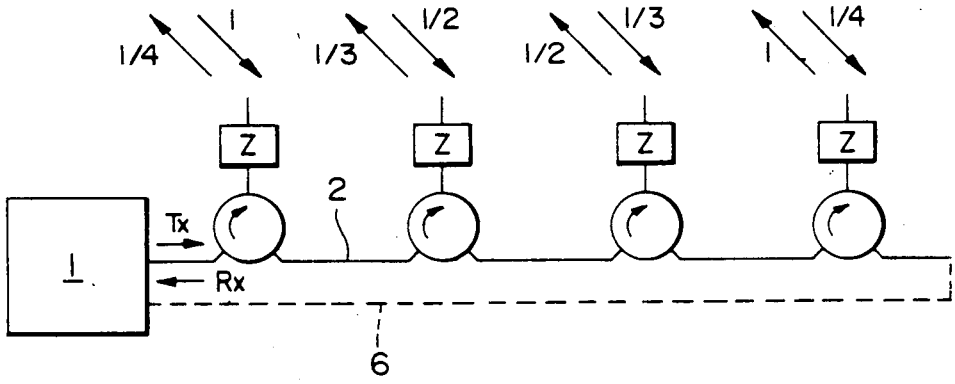
Figure 3:
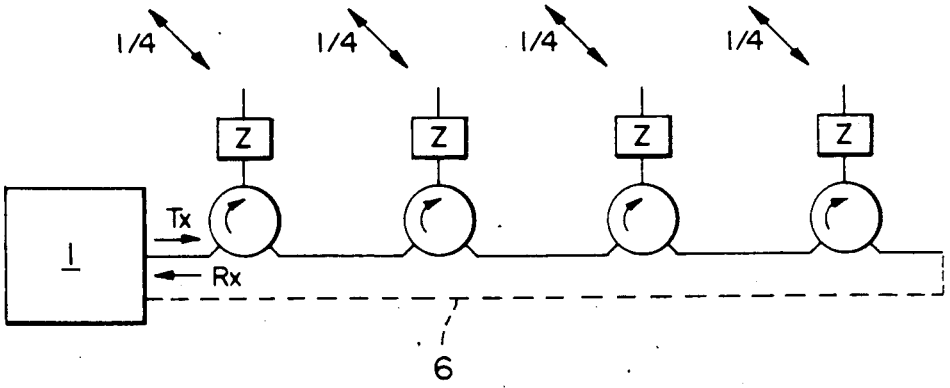

By way of example, some particular embodiments of the invention will now be described with reference to the accompanying drawings in which:

FIG. 1 is a circuit diagram of an antenna feed system having four antennas connected to a common power line, FIGS. 2 and 3 are similar diagrams showing modifications to the system.

As depicted in FIG. 1, a transmit source 1 provides a RF signal which is fed along a power line 2 to each of four antennas 3. Each antenna 3 is connected to the power line by a RF circulator 4. Each antenna 3 is deliberately mismatched the effect of which is shown symbolically as a box 8 between the circulator 4 and the antenna 3, to the line so that it will radiate only a particular fraction of the incident power. For the four antenna example illustrated, the first antenna radiates $\frac{1}{4}$ of the total power, passing $\frac{3}{4}$ to the next which radiates $\frac{1}{3}$ of this (that is, $\frac{1}{4}$ of the total). The third antenna radiates $\frac{1}{2}$ of the 2/4 fraction (that is, $\frac{1}{4}$ of the total) and the fourth antenna radiates all of the power received, that is $\frac{1}{4}$ of the total. Thus each antenna radiates exactly one quarter of the total power assuming lossless feeders and circulators have been used.

This way of proportioning the total amount of incident power could be extended to any number of antennas N, where the Mth antenna would radiate 1/(N-M+1) of the incident power or 1/N of the total power.

Whilst this circuit will operate perfectly satisfactorily, there are two ways in which it could be improved. Firstly, the matching of each antenna in the system is different from that of the other antennas present. Secondly, the antenna system will work either as a transmit or as a receive system.

If this antenna structure is considered in more detail, the first antenna will receive $\frac{1}{4}$ of the signal in its vicinity but this signal will be progressively re-radiated by the other antennas of the array until the last antenna radiates all of the signal without leaving any signal for reception. In fact the last antenna is the only one which can receive a signal. All of the signal from this antenna will be routed to the feeder. The signal at the end of the feeder will be reflected at a mismatched termination and will return through all the circulators, bypassing the antennas, to the source.

This problem can be overcome by the circuit arrangement of FIG. 2. In this system, the signal source 1 is a transmitter/receiver which is arranged to transmit at the frequency F1 and receive at a different frequency F2. The receive and transmit frequencies are thus separated and they are carefully arranged so that the mismatches on the receive frequency are different from those on the transmit frequency. The first antenna 3 would be quarter wave resonant at the receive frequency while the last antenna would be quarter wave resonant at the transmit frequency. Reception, here, is by the receive signal reflecting back down the feeder line 2 from the end furthest from the base unit. Clearly, the directions of the circulators could be reversed if it was preferably to associate the loss of this reflection with the transmit path. In an alternative embodiment, an independent return path 6 could be used as shown by the dotted line.

Whilst this circuit does enable a single antenna system to be used for transmission and reception, there is a limitation in the magnitude of the frequency separation that must be used and indeed in that a frequency separation is necessary at all between the receive and transmit frequencies.

FIG. 3 shows an alternative arrangement which avoids the need for a separation between the transmit and receive frequencies or for a separation which is a relatively small fraction of the mean frequency. In this case, each antenna radiates 1/N of the incident power (where N is the number of antennas, here this is equal to four). Clearly, the power radiated from the last antenna is less than that radiated from the first. In fact, it is reduced by the ratio $(1-\frac{1}{4})$ (4-1) or 3.7 dB. which is not significant. The general expression for the gain at the last (that is, the worst case) antenna relative to the first is $(1-1/N)^{(N-1)}$ which will reduce as N increases. However, the minimum gain, given by the limit of the above expression as N approaches infinity is 1/e or −4.3 dB. Thus, even as the number of antennas becomes very large, the loss from failing to supply equal power to each antenna does not increase substantially. Again, in this embodiment, the circulator directions for transmit and receive operations may be reversed if desired, and the independent return path 6 shown by the dotted line could be used.

The distributed antenna system of the invention has been found to allow substantial cost savings in constructing the installation. The conventional leaky feeder antenna can cost some £10 per foot length whilst a high volume purchase of narrow band circulators can have prices reduced to as low as £2 or £3. The circulators are required perhaps at minimum intervals of three meters so a very significant cost saving is possible.

The foregoing description of embodiments of the invention has been given by way of example only and a number of modifications may be made without departing from the scope of the invention as defined in the appended claims.

I claim:

1. A distributed antenna system comprising a plurality of spaced apart antennas, N, and a plurality of circulators wherein each of said plurality of antennas includes a mismatch and is connected to a respective one of said plurality of circulators, said plurality of circulators being connected by an RF line so that each of said plurality of antennas radiates only a predetermined fraction of RF power on said RF line incident on each of said plurality of antennas, and a last antenna of the system is connected by an independent return line to an RF source for the system.

2. A system as claimed in claim 1, in which transmit and receive signals are delivered to the RF line at differing frequencies.

* * * * *